US005358842A

United States Patent [19]

Kasai et al.

[11] Patent Number: 5,358,842

[45] Date of Patent: Oct. 25, 1994

[54] SILVER HALIDE PHOTOGRAPHIC LIGHT-SENSITIVE MATERIAL

[75] Inventors: Shigetami Kasai; Tadanobu Sekiya; Sadayasu Ishikawa, all of Hino, Japan

[73] Assignee: Konica Corporation, Japan

[21] Appl. No.: 95,086

[22] Filed: Jul. 20, 1993

[30] Foreign Application Priority Data

Jul. 23, 1992 [JP] Japan ..... 4-197169

[51] Int. Cl.[5] ..... G03C 1/035; G03C 1/005

[52] U.S. Cl. ..... 430/569; 430/567

[58] Field of Search ..... 430/567, 569

[56] References Cited

U.S. PATENT DOCUMENTS 5,124,243 6/1992 Mochizuki et al. ..... 430/569

5,244,781 9/1993 Takada ..... 430/567

*Primary Examiner*—Charles L. Bowers, Jr.

*Assistant Examiner*—Mark F. Huff

*Attorney, Agent, or Firm*—Jordan B. Bierman

[57] ABSTRACT

A silver halide photographic light-sensitive material comprising a support having thereon a silver halide emulsion layer containing silver halide grains which meet the following requirements (1) and (2):

(1) the silver halide grains are formed in the presence of an oxidizing agent, and (2) the silver halide grains each have, in respect of distance L from the grain center to the grain surface, a point at which the content of silver iodide becomes maximum within distance $L_1$ from the grain center to 0.67 L, and a point at which the content of silver iodide becomes minimum within distance $L_2$ from 0.58 L to the grain surface and, in each grain, the silver iodide content shows a substantially monotonous decease in the range from $L_1$ to $L_2$, and $$(L_2-L_1)/L>0.20$$

is satisfied.

9 Claims, No Drawings

SILVER HALIDE PHOTOGRAPHIC LIGHT-SENSITIVE MATERIAL

FIELD OF THE INVENTION

The present invention relates to a silver halide emulsion useful in photographic applications and a silver halide photographic light-sensitive material which uses the emulsion. More particularly, the present invention relates to a silver halide photographic light-sensitive material high in sensitivity, improved in desensitization by pressure and fogging by pressure.

BACKGROUND OF THE INVENTION

In recent years, there has been an increasing demand for high performances in a silver halide photographic light-sensitive material, and further improvements are strongly demanded toward much higher photographic properties, particularly toward sensitivity, gradation and lower fog.

In association with such tendencies towards higher sensitivities and higher image qualities, improvements towards higher pressure resistances are also demanded of a silver halide photographic light-sensitive material.

In general, a silver halide photographic light-sensitive material (hereinafter occasionally abbreviated as a light-sensitive material) is subjected to various types of pressure, for example, mechanical stresses such as bending and rubbing applied to a light-sensitive material in the processes of manufacturing, cutting and processing as well as at the time of loading it into a cartridge or a camera.

As is well known, application of such stresses causes fogging (also termed pressure sensitization) or lowering of sensitivity (pressure desensitization) of a light-sensitive material; accordingly, there is a strong demand for a light-sensitive material which is immune from deterioration in photographic properties when subjected to pressure.

Among various methods which have so far been proposed as measures for improving the pressure resistance, methods of including a polymer or a plasticizer, or lowering a ratio of silver halide/gelatin to prevent the pressure from exerting directly on silver halide grains.

Accordingly, there has actively been studied in recent years the use of emulsions comprising core/shell-type silver halide grains having a silver iodobromide phase of high silver iodide content in the core. For example, Japanese Pat. O.P.I. Pub. Nos. 99433/1984, 35726/1985 and 147727/1985 disclose color negative films improved in pressure resistance by use of core/-shell-type silver iodobromide grains having, inside of the grains, a high silver iodide content phase comprising 10 mol % or more silver iodide.

Further, Japanese Pat. O.P.I. Pub. No. 943/1990 discloses a technique to obtain an emulsion of high sensitivity and low pressure fogging property by continuously changing the iodide content inside of grains, without giving a clear core/shell structure to grains. However, this technique has a disadvantage of greatly deteriorating pressure desensitizing resistance, though it brings about improvements in pressure fogging.

As stated above, it is not easy to develop a light-sensitive material having a high sensitivity, a high resolution and improved resistances to pressure fogging and pressure desensitizing and, therefore, a new technique has been strongly sought for the development of such a light-sensitive material.

SUMMARY OF THE INVENTION

Accordingly, an object of the present invention is to provide a silver halide emulsion high in sensitivity and improved in resistances to pressure fogging and pressure desensitizing as well as a silver halide photographic light-sensitive material which uses the silver halide emulsion. Other objects of the present invention will become apparent from the detailed description to follow.

As the result of studies directed to the solution of the problems, the present inventors have found that the foregoing object of the invention is attained by the following constituents.

(a) A silver halide photographic light-sensitive material having at least one silver halide emulsion layer on a support, wherein said emulsion layer contains silver halide grains which satisfy the following requirements (1) and (2):

(1) the silver halide grains are formed in the presence of an oxidizing agent, and (2) the silver halide grains each have, in respect of distance L from the grain center to the grain surface, a point at which the content of silver iodide becomes maximum within distance $L_1$ from the grain center to 0.67 L, and a point at which the content of silver iodide becomes minimum within distance $L_2$ from 0.58 L to the grain surface and, in each grain, the silver iodide content shows a substantially monotonous decrease in the range from $L_1$ to $L_2$, and $(L_2-L_1)/L \geqq 0.20$ is satisfied.

(b) A silver halide photographic light-sensitive material of the above (a), wherein the oxidizing agent is a halogen element.

DETAILED DESCRIPTION OF THE INVENTION

In the invention, the center of a silver halide grain is determined as follows. That is, after dispersing a silver halide grain in a methacrylate resin, the resin is cured and sliced into very thin specimens with a microtome. Among the microtomed sections of the grain, the largest one and ones whose sectional areas are 90% or more of that of the largest one are selected. The center of a silver halide grain is given by the center of a circumcircle drawn for each section so as to give the smallest circle.

In the invention, distance L from the center to the surface is defined as the distance from the center of the foregoing circle to the intersecting point of the periphery of a grain and a straight line drawn outward from the center of the circle.

Further, the points at which the silver iodide content become maximum and minimum as well as distances $L_1$ and $L_2$ from the center can be determined by measuring, using the XMA method, silver iodide contents and positions on the foregoing straight line drawn from the center to the periphery.

When the relational expression of the invention is valid for any of L, $L_1$ and $L_2$ each defined on a straight line drawn in an arbitrary direction from the center of the foregoing circumcircle, those silver halide grains which meet this are regarded to be the silver halide grains of the invention.

When a plurality of specific points are found for each of the maximum silver iodide content and the minimum silver iodide content in the measurement of internal structure of the silver halide grain, the specific point farthest from the center is selected for the maximum silver iodide content, and the specific point nearest from the center is selected for the minimum silver iodide content.

In the silver halide grain of the invention, the difference of silver iodide content between the point at which the silver iodide content becomes maximum ($I_{max}$) and the point at which the silver iodide content becomes minimum ($I_{min}$), namely $I_{max}-I_{min}$, is preferably within the range of 5 to 40 mol %, more preferably within the range of 15 to 35 mol %.

The silver halide grain of the invention comprises silver iodobromide having an average silver iodide content of preferably 1 to 20 mol %, more preferably 3 to 15 mol %.

In addition, silver chloride may be contained within the range not harmful to the effect of the invention.

In the silver halide grain of the present invention the silver iodide content in the outermost layer is preferably 6 mol % or less, more preferably 4 mol % or less and most preferably 2 mol % or less.

In the silver halide grain according to the invention, the silver halide grain internal structure in which the silver iodide content decreases substantially monotonously is a structure wherein the silver iodide content decreases (1) linearly, or (2) without having maximum or minimum, from specific point $L_1$ at which the silver iodide content is maximum to specific point $L_2$ at which the silver iodide content is minimum.

In order to bring out the effect of the invention much more, the foregoing structure (1) is preferred. In the silver halide grain according to the invention, the silver iodide content in the area inside of specific point $L_1$ may monotonously decrease toward the center, or may be uniform.

While specific point $L_1$ at which the silver iodide content becomes maximum is located in the range up to 0.67 L from the grain center, it is preferably located in the range up to 0.62 L. Further, in the range from specific point $L_2$ at which the silver iodide content becomes minimum to the grain surface, the silver iodide content may have any value within the range from the minimum content to the maximum content.

In addition, while specific point $L_2$ at which the silver iodide content becomes minimum is located outside of 0.58 L, it is preferably located outside of 0.80 L.

The silver iodide content of each silver halide grain and the average silver iodide content can be determined by the electron probe microanalyzer method (the EPMA method).

This method makes possible to carry out an elemental analysis of a very small portion by the steps of preparing a sample in which emulsion grains are dispersed thoroughly without contacting one another and subjecting the sample to X-ray analysis utilizing the electron ray excitation due to irradiation of electron beams.

The silver halide composition of each grain can be determined by measuring the characteristic X-ray intensities of silver and iodine emitted from each grain. The average silver iodide content can be obtained by measuring silver iodide contents at least for 50 grains by the EPMA method and averaging the measured values.

Preferably, the emulsion of the invention comprises grains among which the silver iodide content is uniform.

The relative standard deviation thereof (coefficient of variation), which is obtained by measuring the distribution of silver iodide content among grains by the EPMA method, is preferably not more than 35%, especially not more than 20%.

The silver iodide content in the surface layer of a silver halide grain can be determined by X-ray photoelectron spectrometry.

In carrying out X-ray photoelectron spectrometry, an emulsion is pretreated before measurement: first, 10 ml of 0.01 wt % aqueous pronase solution is added to about 1 ml of sample, followed by stirring for 1 hour at 40° C. to decompose gelatin. After depositing emulsion grains through centrifugation and removing the supernatant liquid, 10 ml of the aqueous solution of pronase is added thereto to decompose the gelatin again under the above conditions.

After subjecting the sample to centrifugation and removing the supernatant liquid again, 10 ml of deionized water is added, and the emulsion grains are redispersed in the water and centrifuged, followed by removal of the supernatant liquid. After repeating this washing procedure three times, the emulsion grains are redispersed in ethanol (the procedure up to here is carried out in a darkroom). Then, the dispersion is thinly coated on a mirror-polished silicone wafer, in a semi-dark room, to obtain a specimen. The specimen obtained is subjected to measurement by X-ray photoelectron spectrometry within 24 hours.

In this X-ray photoelectron spectrometry, an ESCA/SAM 560 made by Philips Co. is used as measuring equipment. The specimen is fixed on a holder inclined at 60°, subjected to a 10-minute evacuation with a turbomolecular pump in a pre-evacuation chamber, and introduced into a measuring chamber. Within 1 minute after introducing the sample, irradiation of an exciting X-ray (Mg-K $\alpha$ ray) is started, and measurement is immediately begun under the conditions of X-ray radiation source voltage: 15 kV, X-ray radiation source current: 40 mA and pass energy: 50 eV.

To determine the surface silver halide composition, Ag 3d, Br 3d and I 3d3/2 electrons are detected. In detecting the Ag 3d electron, measurement is made within the bond energy range of 381 eV to 361 eV, at scanning steps of 0.2 eV, by making one 100-msec scanning for each scanning step. In detecting the Br 3d electron, measurement is made within the overall energy range of 79 eV to 59 eV, at scanning steps of 0.2 eV, by repeating a 100-msec scanning five times for each scanning step. In detecting the I 3d3/2 electron, measurement is made within the overall energy range of 644 eV to 624 eV, at scanning steps of 0.2 eV, by repeating a 100-msec scanning forty times for each scanning step. The above procedure is repeated two times, and the measured values are integrated to obtain data to be recorded.

The composition ratio is calculated by use of the integrated intensity of each peak. The integrated intensity of the Ag 3d peak is determined in cps.eV by taking, as base line, a straight line connecting the intensity of energy given by adding 4 eV to the overall energy at which the Ag 3d3/2 peak shows the maximum value and the intensity of energy given by adding 4 eV to the bond energy at which the Ag 3d5/2 peak shows the maximum value. The integrated intensity of the Br 3d peak is determined in cps.eV by taking, as base line, a straight line connecting the intensity of energy given by adding 4 eV to the overall energy at which the Br 3d5/2 peak shows the maximum value and the intensity of energy given by subtracting 3 eV from the overall energy at which the Br 3d5/2 peak shows the maximum value. And the integrated intensity of the I 3d3/2 peak is determined in cps.eV by taking, as base line, a straight line connecting the intensity of energy given by adding 4 eV to the overall energy at which the I 3d3/2 peak shows the maximum value and the intensity of energy given by subtracting 4 eV from the overall energy at which the I 3d3/2 peak shows the maximum value.

In making a calculation of the composition ratio from the integrated intensities of the respective peaks, the relative sensitivity coefficient method is used, and the composition can be obtained in atomic percents by taking 5.10, 0.81 and 4,592, respectively, as relative sensitivity coefficients of Ag 3d, Br 3d and I 3d3/2.

Next, an oxidizing agent of the present invention means compounds having an effect to work on metallic silver to convert it to silver ions. Especially, compounds converting extremely fine silver atoms which occur in the course of conversion process of silver halide grains to silver ions.

The oxidizing agent of the present invention is preferably a halogen element and more preferably iodine.

Added amounts of the oxidizing agent of the present invention is desirably in the range of $10^{-7}$ to $10^{-1}$ mol, preferably in the range of $10^{-6}$ to $10^{-2}$ mol and particularly preferably $10^{-5}$ to $10^{-3}$ mol per mol of silver.

Oxidizing agents are allowed to be added to a reacting vessel prior to the growth of grains, and also allowed to be added at an arbitrary point from the growth of grains to desalting. In order to enhance the effects of the present invention as much as possible, it is preferable to add an oxidizing agent at a time between $L_1$ and $L_2$, and most preferable to add them when the growth of grains reaches the point of $L_1$, For adding oxidizing agents in the present invention into the emulsion preparing step, conventional methods for adding additives can be applied. For example, they are allowed to be added in the form of aqueous solutions with suitable density by dissolving them to water, and also allowed to be added in the form of solutions by dissolving them to suitable organic solvents capable of mixing with water and not influencing adverse effects in terms of photographic performances such as alcohols, glycols, ketones, esters and amides. In addition, solids are allowed to be added directly. Methods for addition include a rush addition method, a uniform-speed addition method and a functional addition method.

Incidentally, Japanese Patent Publication Open to Public Inspection Nos. 189641/1991, 194540/1991 and 196135/1991 were disclosed each appealing that silver halide grains having high speed and low fogging were attained by forming them in the presence of an oxidizing agent for silver.

However, aforesaid methods related to a technology reducing fogging by oxidizing silver nucleus inside of or on the surface of silver halide grains. With regard to improvement in durability of a light-sensitive material to pressure (for example, pressure desensitization) that is the object of the present invention, there was no suggestion in them.

The silver halide emulsion according to the invention is prepared in the presence of a dispersion medium, namely, in an aqueous solution containing a dispersion medium. An aqueous solution containing a dispersion medium means an aqueous solution in which a protective colloid is formed by a hydrophilic-colloid-forming substance (a substance functions as binder, etc.) such as gelatin or the like. Preferred examples thereof include aqueous solutions containing a protective gelatin in colloidal state.

In the embodiment of the invention, the gelatin used as the above protective colloid may be any of lime-processed ones and acid-processed ones.

Manufacture of these gelatins is described in detail in A. Veis, "The Macromolecular Chemistry of Gelatin", Academic Press (1964).

Hydrophilic colloids usable as protective colloids include, in addition to gelatins, gelatin derivatives; grafted polymers of gelatin with other polymers; proteins such as albumin and casein; cellulose derivatives such as hydroxyethyl cellulose, carboxymethyl cellulose, cellulose sulfate; sodium alginate; sugar derivatives such as starch derivatives; and various hydrophilic synthetic polymers including homopolymers and copolymers such as polyvinyl alcohol, partial acetals of polyvinyl alcohol, poly-N-vinylpyrrolidone, polyacrylic acid, polymethacrylic acid, polyacrylamide, polyvinylimidazole and polyvinylpyrazole.

When gelatin is used, preferred is one having a jelly strength of 200 or more according to the PAGI method.

A silver halide emulsion prepared in the present invention may be grown from seed crystals or formed through the formation of nucleii. The form of silver halide emulsion grains prepared may be ordinary crystals including cubic, octahedron or tetradecahedron crystals. In addition, they may be twinned, such as tabular.

The silver halide emulsion prepared in the present invention may be either of silver iodochloride, silver iodobromide or silver iodobromochloride. However, silver iodobromide is preferable in that a high speed emulsion can be obtained.

The silver halide emulsion of the invention may be either a polydispersed emulsion having a wide grain size distribution or a monodispersed emulsion having a narrow grain size distribution, and each emulsion may be a single emulsion or a mixture of these emulsions. But, when a light-sensitive material is prepared by use of the emulsion of the invention, a monodispersed emulsion is preferred.

In such a monodispersed silver halide emulsion, the weight of silver halide grains whose grain sizes fall within ±20% of average grain size r is preferably 60 wt % or more, more preferably 70 wt % or more and most preferably 80 wt % or more of the total weight of silver halide grains.

In the invention, average grain size r is defined as grain size ri at which the product of frequency ni of grains having grain size ri and $ri^3$, namely $ni \times ri^3$, becomes largest (three significant figures, the last figure is rounded to the nearest whole number).

The term "grain size" used here means the diameter of a grain for a spherical silver halide grain, or the diameter of a disk having an area equal to the projected area of a grain for a non-spherical grain.

The grain size can be measured, for example, by photographing a grain on an electron microscope at magnifications of 10,000 to 50,000 and measuring the grain's diameter or the grain's projected area on the print (the number of grains to be measured is at least 1000 selected at random).

Highly monodispersed emulsions are particularly advantageous in the embodiment of the invention. When the extent of grain size distribution is defined by $$\frac{\text{Standard Deviation}}{\text{Average Grain Size}} \times 100 = \text{Width of Distribution (\%)},$$

the extent of distribution (or coefficient of variation) of such emulsions is preferably not more than 20% and more preferably not more than 15%.

The average grain size and the standard deviation used here are determined from the foregoing grain size ri.

These monodispersed emulsions can be prepared by adding, to an aqueous solution of gelatin containing seed grains, two or more reaction elements arbitrarily selected from a solution of water-soluble silver salt, a solution of water-soluble halide and silver halide fine grains, with the pAg and pH controlled appropriately. In deciding the addition speed, the description in Japanese Pat. O.P.I. Pub. Nos. 48521/1979 and 49938/1983 can be referred to.

Further, the method disclosed in Japanese Pat. O.P.I. Pub. No. 122935/1985, which grows grains in the presence of tetraazaindene, can be utilized for the preparation of much highly monodispersed emulsions.

In manufacturing the silver halide emulsion of the invention, the control of pAg is very important during the growth of crystals. The pAg during the growth of crystals is preferably 6 to 12.

During the formation of silver halide, the pAg may be kept constant, or may be changed stepwise or continuously. When changed, the pAg is preferably raised as the formation of silver halide grains proceeds.

In the manufacture of the silver halide emulsion according to the invention, stirring conditions during the manufacture are very important. In a preferable embodiment of the invention, stirring is performed at stirring speeds of 200 to 1000 rpm by use of the stirring equipment disclosed in Japanese Pat. O.P.I. Pub. No. 160128/1987, this equipment supplies an aqueous solution of silver salt and an aqueous solution of halide by the double-jet method.

During the preparation of the silver halide emulsion of the invention, there may be present conventional silver halide solvents such as ammonia, thioether and thiourea, or these silver halide solvents need not be used.

In the process to form grains and/or in the process to grow grains, there may be added metal ions by use of at least one compound selected from cadmium salts, zinc salts, lead salts, thallium salts and iridium salts (including complex salts) for the purpose of incorporating these metal elements in the inner portion of grains and/or on the surface of grains. Further, there may be provided reduction-sensitized specks in the inner portion of grains and/or on the surface of grains by subjecting these grains to a reducing atmosphere.

The silver halide grains may be those which form latent images mainly on the surface or those which form latent images mainly in the inner portion. And the size of these grains is preferably 0.05 to 5.0 μm, more preferably 0.1 to 3.0 μm.

The silver halide emulsion of the invention may be one from which useless soluble salts are removed after the growth of silver halide grains, or one which holds such salts unremoved.

Desalting may be made anytime during the growth of silver halide grains as described in Japanese Pat. O.P.I. Pub. No. 138538/1985. Removal of salts can be carried out according to the methods described in Research Disclosure No. 17643, Sec. II. That is, in order to remove soluble salts from an emulsion after forming precipitates or after physical ripening, there may be used the noodle washing method which performs desalting by gelation of gelatin, or the flocculation method which utilizes inorganic salts, anionic surfactants, anionic polymers (polystyrenesulfonic acid, etc.) or gelatin derivatives (acylated gelatin, carbamoylated gelatin, etc.).

The silver halide emulsion of the invention can be chemically sensitized by the usual method; that is, there can be employed, singly or in combination, sulfur sensitization, selenium sensitization, reduction sensitization, and noble metal sensitization with gold or other noble metals.

The silver halide emulsion of the invention may be optically sensitized to a desired wavelength range by use of dyes known as sensitizing dyes in the art. Sensitizing dyes may be used singly or in combination of two or more types. In addition, there may be used, jointly with sensitizing dyes, supersensitizers which comprise dyes having no sensitizing function by themselves, or compounds absorbing substantially no visible light, but having capabilities of raising the sensitizing function of sensitizing dyes.

The silver halide emulsion of the invention may contain antifoggants and stabilizers. As a binder for the emulsion, gelatin is advantageously used.

Emulsion layers and other hydrophilic colloidal layers may be hardened and, further, may contain plasticizers and latex of water insoluble or sparingly soluble synthetic polymers.

In emulsion layers of a color light-sensitive material, couplers are employed. Further, there may be contained competitive couplers having color correction capabilities as well as compounds capable of releasing, upon coupling with an oxidation product of developing agent, photographically useful fragments such as developing accelerators, developers, silver halide solvents, toning agents, hardeners, foggants, antifoggants, chemical sensitizers, optical sensitizers or desensitizers.

In the light-sensitive material, auxiliary layers such as a filter layer, antihalation layer and anti-irradiation layer may be provided. These layers and/or emulsion layers may contain dyes which are washed out or bleached while the light-sensitive material is processed.

The light-sensitive material may contain matting agents, lubricants, image stabilizers, formalin scavengers, UV absorbents, optical whitening agents, surfactants, developing accelerators and developing retarders.

As supports, polyethylene laminated paper, polyethylene terephthalate film, baryta paper and cellulose triacetate film can be used.

EXAMPLES

The invention is hereunder described in detail with examples, but the scope of the invention is not limited to these examples.

Example 1

Preparation of Twin Seed Emulsion T-1

Seed emulsion T-1 comprising crystal grains having two parallel twin planes was prepared as follows:

| | |
|---|---|
| Solution A | |
| Ossein gelatin | 80.0 g |
| Potassium bromide | 47.4 g |
| 10% methanol solution of sodium polyisopropylene-polyethyleneoxy-disuccinate | 0.48 ml |
| Water was added to make | 8000.0 ml |
| Solution B | |
| Silver nitrate | 1200.0 g |
| Water was added to make | 1600.0 ml |
| Solution C | |
| Ossein gelatin | 32.2 g |
| Potassium bromide | 790.0 g |
| Potassium iodide | 70.34 g |
| Water was added to make | 1600.0 ml |
| Solution D | |
| Aqueous ammonia | 470.0 ml |

While vigorously stirring solution A at 40° C., solutions B and C were added thereto in 7.7 minutes by the double-jet method to form crystalline nuclei. During the addition, the pBr was kept at 1.60.

Then, the temperature was lowered to 20° C. in 30 minutes. Further, solution D was added to the reaction system in 1 minute, followed by a 5-minute ripening with the KBr concentration at 0.03 mol/l and the ammonia concentration at 0.66 mol/l After completing the ripening, the pH was adjusted to 6.0 and desalting was carried out in the usual manner. Electron microscopic observations of the resultant seed grains proved that these grains were hexagonal tabular grains having two twin planes parallel to each other.

The average grain size of the seed grains was 0.217 μm, and grains having two parallel twin planes amounted to 75% of the total number of grains.

Preparation of Emulsion EM-1 of the Invention

Emulsion EM-1 of the invention, an emulsion comprising monodispersed octahedral twin crystal grains, was prepared using the following seven solutions:

| | |
|---|---|
| Solution A | |
| Ossein gelatin | 61.0 g |
| Deionized water | 1963.0 ml |
| 10% methanol solution of sodium polyisopropylene-polyethyleneoxy-disuccinate | 2.5 ml |
| Seed emulsion T-1 | 0.345 mol |
| 28 wt % Aqueous ammonia | 308.0 ml |
| 56 wt % Aqueous acetic acid solution | 358.0 ml |
| Deionized water was added to | 2000.0 ml |
| Solution B | |
| 3.5N Aqueous solution of ammoniacal silver nitrate (pH was adjusted to 9.0 with ammonium nitrate) | |
| Solution C | |
| 3.5N Aqueous solution of potassium bromide | |
| Solution D | |
| 3 wt % Gelatin and 1.40 mol of silver iodide fine grain emulsion (average grain size: 0.05 μm) prepared as follows: | |
| Solution E | |
| 3.68 mol of silver iodobromide fine grain emulsion (average grain size: 0.04 μm) containing 2 mol % of silver iodide, which was prepared in a manner similar to the silver iodide fine grain emulsion of solution D (The temperature was controlled at 30° while fine grains were formed.) | |
| Solution F | |
| 1.75N Aqueous potassium bromide solution | |
| Solution G | |
| 56 wt % Aqueous acetic acid solution | |

Preparation of Silver Iodide Fine Grain Emulsion

To 5000 ml of 6.0 wt % gelatin solution containing 0.06 mol of potassium iodide were added in 10 minutes 2000 ml each of an aqueous solution containing 7.06 mol of silver nitrate and an aqueous solution containing 7.06 mol of potassium iodide. During the formation of fine grains, the pH was adjusted to 2.0 with nitric acid and the temperature was kept at 40° C. After the formation of fine grains, the pH was adjusted to 6.0 with an aqueous solution of sodium carbonate.

While stirring solution A vigorously at 70° C. in a reaction vessel, solutions B, C and D were added thereto in 188 minutes by the double-jet method and, then, solution E was added in 7 minutes at a constant flow rate, so that the seed crystals were grown up to 0.806 μm.

The addition rates of solutions B and C were changed as a function of time so as to be balanced with the critical growth rate; that is, the addition rates were properly controlled to prevent formation of small grains other than seed grains being grown and polydispersing due to the Ostwald ripening.

Solution D, or silver iodide fine grain emulsion, was supplied while changing its addition rate ratio (molar ratio×100) to the aqueous solution of ammoniacal silver nitrate (Solution B) in relation to the grain size (the addition time) as shown in the following Table 1, so that emulsion EM-1, a silver iodobromide emulsion having a continuous silver iodide composition of the invention, was obtained.

33.7 mol of methanol solution containing iodine of 450 mg ($1\times10^{-4}$ mol/mol Ag) was instantaneously added at 64.89 min. (0.58 L) after the start of addition of aqueous solution of ammoniacal silver nitrate (Solution B).

During the growth of crystal grains, the pAg and pH were controlled by use of solutions F and G as shown in Table 1. Measurements of pAg and pH were made by the usual method using a silver sulfide electrode and a glass electrode.

After the growth of grains, desalting was carried out according to the method described in Japanese Pat. Appl. No. 41314/1991, and the grains were redispersed by adding gelatin. Then, the emulsion obtained was adjusted to pH 5.80 and pAg 8.06° at 40° C.

From a scanning electron microphotograph of the resultant emulsion grains, the emulsion was proved to comprise monodispersed octahedral twin grains having an average grain size of 0.806 μm and an extent of distribution of 13.0%.

Inventive emulsion EM-2 was prepared in the same manner as in emulsion EM-1, except that iodine was added at a time of 108 minutes (0.69 L) after the start of addition of aqueous solution of ammoniacal silver nitrate (Solution B).

TABLE 1

| Addition Time (min) | Grain Size (μm) | Addition rate Ratio of Solution D | pH | pAg |
|---|---|---|---|---|
| 0.0 | 0.217 | 6.0 | 7.2 | 7.8 |
| 26.20 | 0.345 | 20.1 | 7.2 | 7.8 |
| 40.86 | 0.394 | 29.5 | 7.2 | 7.8 |
| 41.57 | 0.397 | 30.0 | 7.2 | 7.8 |
| 54.11 | 0.434 | 30.0 | 7.2 | 7.8 |
| 64.89 | 0.466 | 30.0 | 7.2 | 7.8 |
| 68.00 | 0.480 | 27.9 | 7.2 | 7.8 |
| 78.00 | 0.500 | 24.9 | 7.2 | 7.8 |

TABLE 1-continued

| Addition Time (min) | Grain Size (μm) | Addition rate Ratio of Solution D | pH | pAg |
|---|---|---|---|---|
| 88.00 | 0.520 | 21.9 | 7.2 | 7.8 |
| 98.00 | 0.540 | 18.9 | 7.2 | 7.8 |
| 108.00 | 0.560 | 15.9 | 7.2 | 7.8 |
| 118.00 | 0.580 | 12.9 | 7.2 | 7.8 |
| 128.00 | 0.600 | 9.9 | 7.2 | 7.8 |
| 138.00 | 0.620 | 6.9 | 6.5 | 9.7 |
| 138.00 | 0.620 | 6.9 | 6.5 | 9.7 |
| 148.00 | 0.640 | 3.9 | 6.5 | 9.7 |
| 158.00 | 0.666 | 0.0 | 6.5 | 9.7 |
| 188.00 | 0.745 | 0.0 | 6.5 | 9.7 |

*In this portion the iodide composition was continuously changed.

Emulsion EM-3 of the invention was prepared in the same manner as emulsion EM-1, except that the addition rate ratio of solution D, or silver iodide fine grain emulsion, to the aqueous solution B of ammoniacal silver nitrate, (molar ratio×100) was changed.

Preparation of Emulsion EM-4 for Comparison

Emulsion EM-4 for comparison was prepared in the same manner as emulsion Em-1, except that the addition rate ratio (molar ratio×100) of solution D, or silver iodide fine grain emulsion, to the aqueous solution of ammoniacal silver nitrate (solution B) was changed in relation to the grain size (the addition time) as shown in the following Table 2.

TABLE 2

| Addition Time (min) | Grain Size (μm) | Addition rate Ratio of Solution D | pH | pAg |
|---|---|---|---|---|
| 0.0 | 0.217 | 6.0 | 7.2 | 7.8 |
| 26.20 | 0.345 | 20.1 | 7.2 | 7.8 |
| 40.86 | 0.394 | 29.5 | 7.2 | 7.8 |
| 41.57 | 0.397 | 30.0 | 7.2 | 7.8 |
| 54.11 | 0.434 | 30.0 | 7.2 | 7.8 |
| 64.89 | 0.466 | 30.0 | 7.2 | 7.8 |
| 64.89 | 0.466 | 20.0 | 7.2 | 7.8 |
| 90.00 | 0.558 | 20.0 | 7.2 | 7.8 |
| 90.00 | 0.558 | 12.1 | 7.2 | 7.8 |
| 107.50 | 0.620 | 12.1 | 7.2 | 7.8 |
| 123.00 | 0.666 | 12.1 | 6.5 | 9.7 |
| 123.00 | 0.666 | 0.0 | 6.5 | 9.7 |
| 128.00 | 0.745 | 0.0 | 6.5 | 6.5 |

Emulsion EM-5 for comparison was prepared in the same manner as in emulsion EM-1, except that iodine was not added into solution A.

Emulsion EM-6 for comparison was prepared in the same manner as emulsion EM-1, except that addition rate ratio of solution D, or silver iodide fine grain emulsion, to the aqueous solution of ammoniacal silver nitrate (solution B) was changed.

Emulsion EM-7 for comparison was prepared in the same manner as emulsion EM-4, except that iodine was not added into solution A.

Emulsions EM-1 to EM-7 prepared as above were comprised of silver iodobromide grains having octahedral crystal phases.

The position at which the iodide content become maximum and minimum within the grain were determined, using X-ray microanalyzer (XMA method) as aforementioned, for each of grains of emulsions EM-1 to EM-7.

Table 3 shows results of emulsions EM-1 to EM-7.

TABLE 3

| Emulsion | $L_1$ [μm] | $L_2$ [μm] | $\frac{L_2 - L_1}{L}$ | Distribution width [%] | Position of iodine addition [μm] | Added amount of iodine [mol/mol Ag] |
|---|---|---|---|---|---|---|
| EM-1 (inv.) | 0.58L | 0.83L | 0.25 | 13.0 | 0.58L | $1 \times 10^{-4}$ |
| EM-2 (inv.) | 0.58L | 0.83L | 0.25 | 13.5 | 0.69L | $1 \times 10^{-4}$ |
| EM-3 (inv.) | 0.58L | 0.79L | 0.21 | 13.2 | 0.58L | $1 \times 10^{-4}$ |
| EM-4 (comp.) | Having no continuous structure in iodide composition | | | 24.2 | 0.58L | $1 \times 10^{-4}$ |
| EM-5 (comp.) | 0.58L | 0.83L | 0.25 | 23.9 | — | — |
| EM-6 (comp.) | 0.71L | 0.75L | 0.04 | 21.5 | 0.58L | $1 \times 10^{-4}$ |
| EM-7 (comp.) | Having no continuous structure in iodide composition | | | 26.2 | — | — |

Example 2

(Preparation of Light-sensitive Material)

Emulsions EM-1 to EM-7 were optimally subjected to gold.sulfur sensitization. Using these emulsions, layers of the following compositions were formed in order on a triacetyl cellulose film support to prepare a multilayered color light-sensitive material.

In the description to follow, addition amounts to the light-sensitive material are in grams per square meter unless otherwise specified. Amounts of silver halide and colloidal silver are given in amounts of silver present, amounts of sensitizing dyes are given in moles per mole of silver halide.

The multilayered color photographic light-sensitive material, sample No. 1, (emulsion EM-1 of invention was used) comprised the following layers:

| | |
|---|---|
| 1st layer: antihalation layer | |
| Black colloidal silver | 0.16 |
| UV absorbent UV-1 | 0.30 |
| Gelatin | 1.70 |
| 2nd layer: intermediate layer (IL-1) | |
| Gelatin | 0.80 |
| 3rd layer: low-speed red-sensitive layer (R-L) | |
| Silver iodobromide emulsion (average grain size: 0.30 μm) | 0.40 |
| Sensitizing dye S-1 | $1.2 \times 10^{-4}$ |
| Sensitizing dye S-2 | $0.2 \times 10^{-4}$ |
| Sensitizing dye S-3 | $2.0 \times 10^{-4}$ |
| Sensitizing dye S-4 | $1.2 \times 10^{-4}$ |
| Cyan coupler C-1 | 0.33 |
| Colored cyan coupler CC-1 | 0.05 |
| High boiling solvent Oil-1 | 0.30 |

-continued

| | |
|---|---|
| Gelatin | 0.55 |
| 4th layer: medium-speed red-sensitive layer (R-M) | |
| Silver iodobromide emulsion (average grain size: 0.4 μm) | 0.48 |
| Sensitizing dye S-1 | $1.5 \times 10^{-4}$ |
| Sensitizing dye S-2 | $0.2 \times 10^{-4}$ |
| Sensitizing dye S-3 | $2.5 \times 10^{-4}$ |
| Sensitizing dye S-4 | $1.5 \times 10^{-4}$ |
| Cyan coupler C-1 | 0.30 |
| Colored cyan coupler CC-1 | 0.05 |
| High boiling solvent Oil-1 | 0.40 |
| Gelatin | 0.60 |
| 5th layer: high-speed red-sensitive layer (R-H) | |
| Silver iodobromide emulsion (average grain size: 0.55 μm) | 0.66 |
| Sensitizing dye S-1 | $1.0 \times 10^{-4}$ |
| Sensitizing dye S-2 | $0.2 \times 10^{-4}$ |
| Sensitizing dye S-3 | $1.7 \times 10^{-4}$ |
| Sensitizing dye S-4 | $1.0 \times 10^{-4}$ |
| Cyan coupler C-2 | 0.10 |
| Colored cyan coupler CC-1 | 0.01 |
| DIR compound D-1 | 0.02 |
| High boiling solvent Oil-1 | 0.15 |
| Gelatin | 0.53 |
| 6th layer: intermediate layer (IL-2) | 0.80 |
| Gelatin | |
| 7th layer: low-speed green-sensitive layer (G-L) | |
| Silver iodobromide emulsion (average grain size: 0.40 μm) | 0.60 |
| Silver iodobromide emulsion (average grain size: 0.30 μm) | 0.40 |
| Sensitizing dye S-1 | $0.6 \times 10^{-4}$ |
| Sensitizing dye S-5 | $5.1 \times 10^{-4}$ |
| Magenta coupler M-1 | 0.55 |
| Colored magenta coupler CM-1 | 0.17 |
| DIR compound D-2 | 0.03 |
| High boiling solvent Oil-2 | 0.70 |
| Gelatin | 1.56 |
| 8th layer: high-speed green-sensitive layer (G-H) | |
| Silver iodobromide emulsion (emulsion EM-1 of the invention) | 0.60 |
| Sensitizing dye S-6 | $1.5 \times 10^{-4}$ |
| Sensitizing dye S-7 | $1.5 \times 10^{-4}$ |
| Sensitizing dye S-8 | $1.5 \times 10^{-4}$ |
| Magenta coupler M-1 | 0.06 |
| Magenta coupler M-2 | 0.02 |
| Colored magenta coupler CM-2 | 0.02 |
| DIR compound D-3 | 0.002 |
| High boiling solvent Oil-2 | 0.15 |

-continued

| | |
|---|---|
| Gelatin | 0.45 |
| 9th layer: yellow filter layer (YC) | |
| Yellow colloidal silver | 0.12 |
| HS-1 | 0.20 |
| HS-2 | 0.14 |
| High boiling solvent Oil-2 | 0.18 |
| Gelatin | 0.80 |
| 10th layer: low-speed blue-sensitive layer (B-L) | |
| Silver iodobromide emulsion (average grain size: 0.4 μm) | 0.18 |
| Silver iodobromide emulsion (average grain size: 0.3 μm) | 0.35 |
| Sensitizing dye S-9 | $5.1 \times 10^{-4}$ |
| Sensitizing dye S-10 | $2.0 \times 10^{-4}$ |
| Yellow coupler Y-1 | 0.58 |
| Yellow coupler Y-2 | 0.30 |
| High boiling solvent Oil-2 | 0.15 |
| Gelatin | 1.20 |
| 11th layer: high-speed blue-sensitive layer (B-H) | |
| Silver iodobromide emulsion (average grain size: 0.65 μm) | 0.45 |
| Sensitizing dye S-9 | $2.8 \times 10^{-4}$ |
| Sensitizing dye S-10 | $1.0 \times 10^{-4}$ |
| Yellow coupler Y-1 | 0.10 |
| High boiling solvent Oil-2 | 0.04 |
| Gelatin | 0.50 |
| 12th layer: 1st protective layer (Pro-1) | |
| Silver iodobromide emulsion (average grain size: 0.07 μm) | 0.30 |
| UV absorbent UV-1 | 0.07 |
| UV absorbent UV-2 | 0.10 |
| High boiling solvent Oil-2 | 0.07 |
| High boiling solvent Oil-3 | 0.07 |
| HS-1 | 0.25 |
| Gelatin | 0.80 |
| 13th layer: 2nd protective layer (Pro-2) | |
| Alkali-soluble matting agent (average particle size: 2 μm) | 0.13 |
| Polymethyl methacrylate (average particle size: 3 μm) | 0.02 |
| Gelatin | 0.50 |

Besides the above compositions, coating aid Su-1, dispersing agent Su-2, hardeners H-1 and H-2, dyes AI-1 and AI-2 were properly added.

Chemical structures of the compounds used in the above light-sensitive material are as follows:

C-1

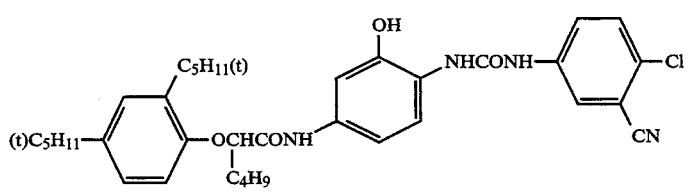

C-2

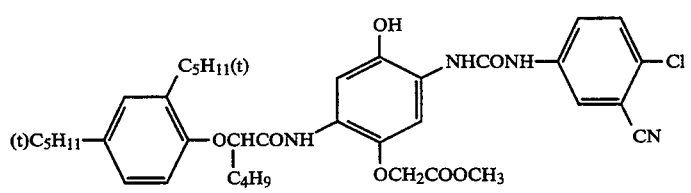

-continued
M-1
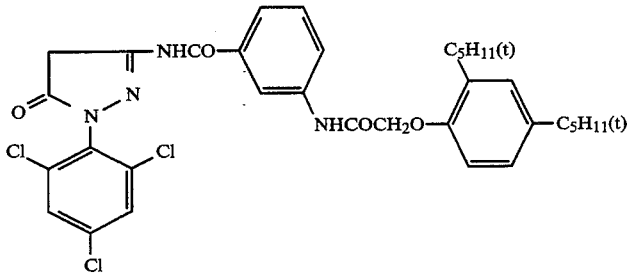
M-2
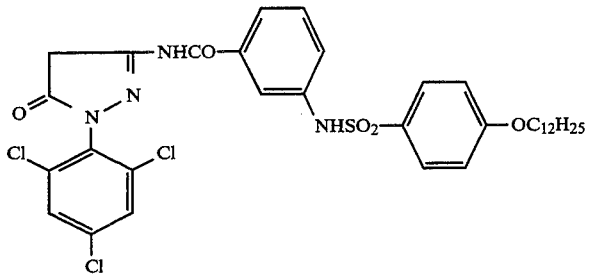
Y-1
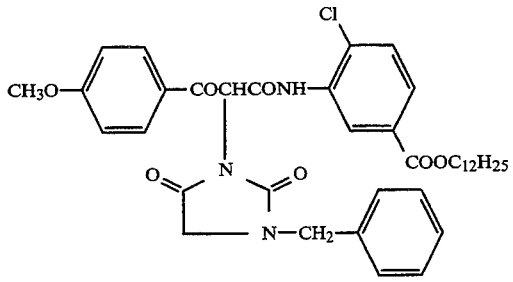
Y-2
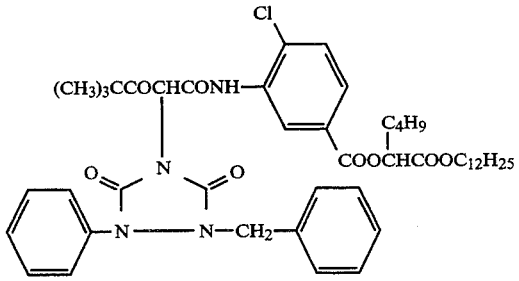
CC-1
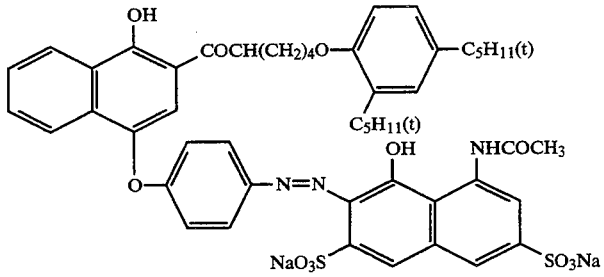

-continued
CM-1
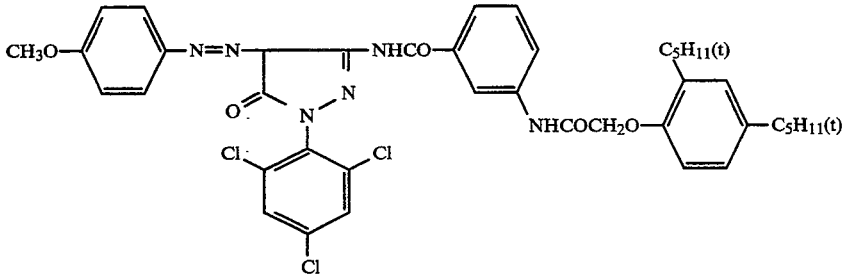
CM-2
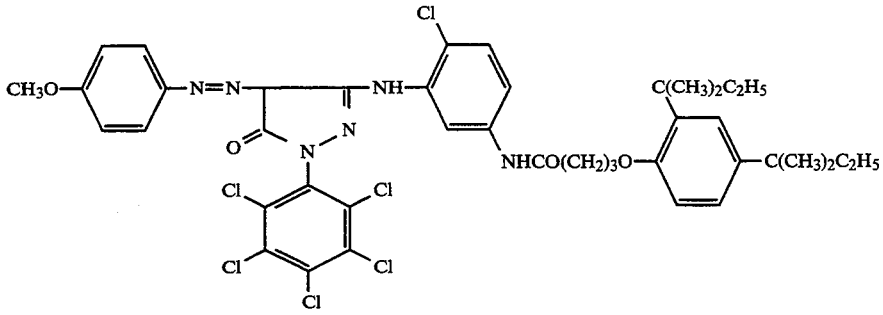
D-1
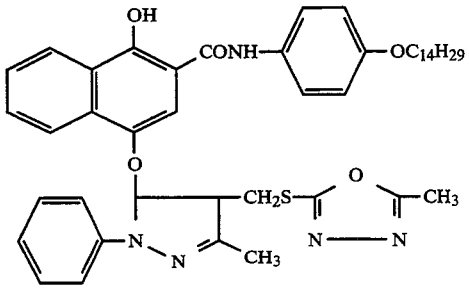
D-2
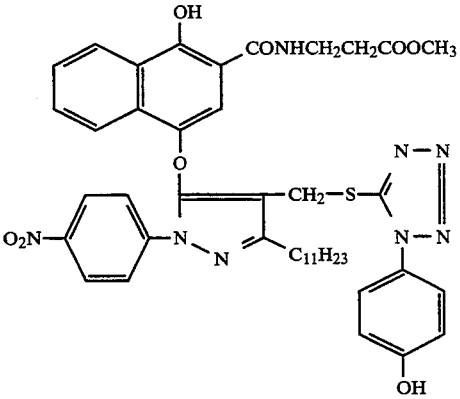
D-3
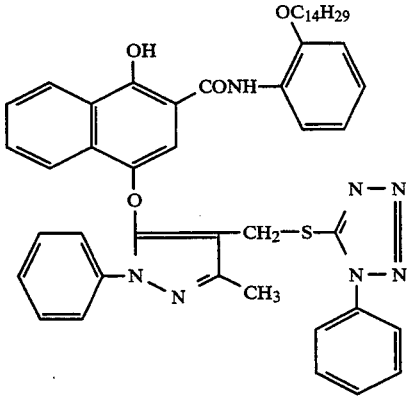

-continued
Oil-1
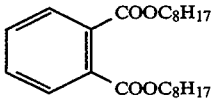
Oil-2
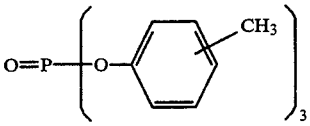
Oil-3
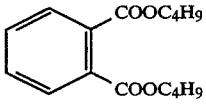
SU-1
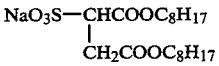
SU-2
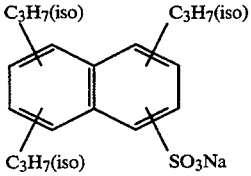
HS-1
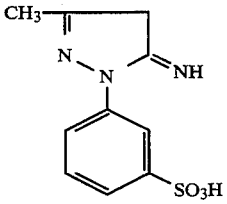
HS-2
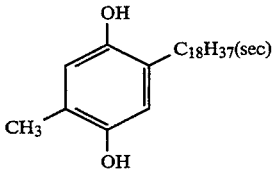
H-1
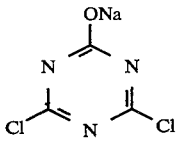
H-2
$(CH_2{=}CHSO_2CH_2)_2O$
UV-1
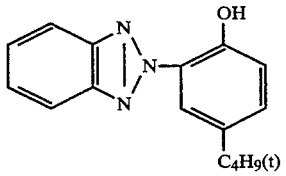
UV-2
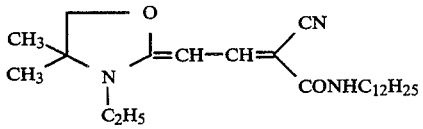

-continued
S-1
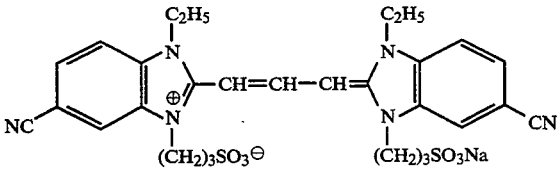
S-2
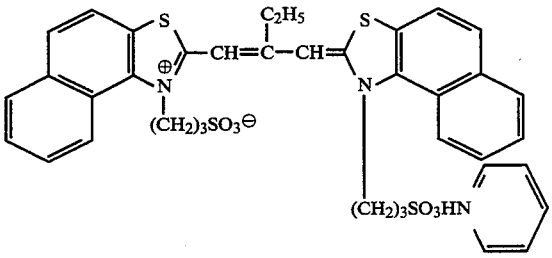
S-3
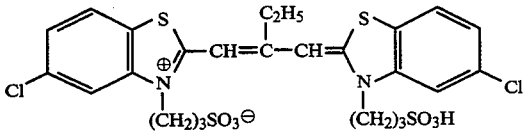
S-4
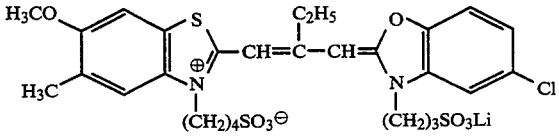
S-5
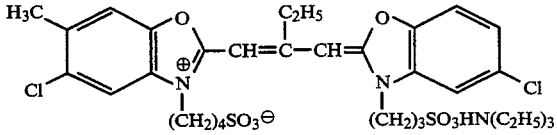
S-6
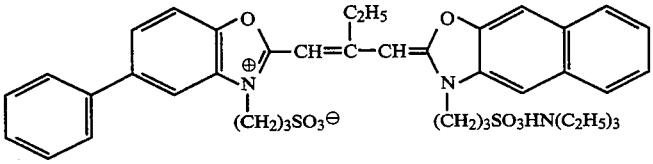
S-7
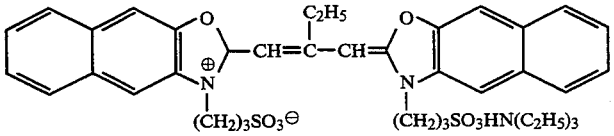
S-8
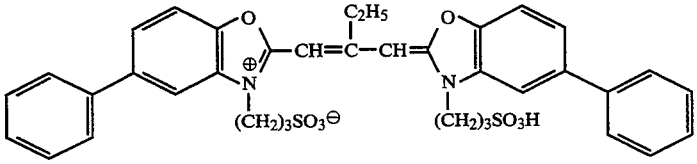
S-9
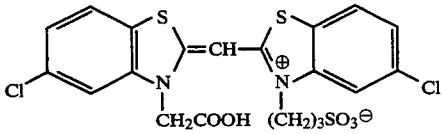

-continued

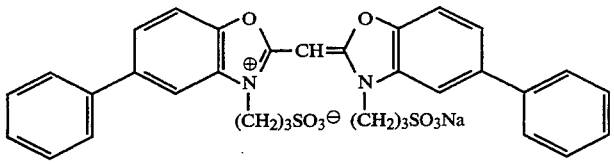

S-10

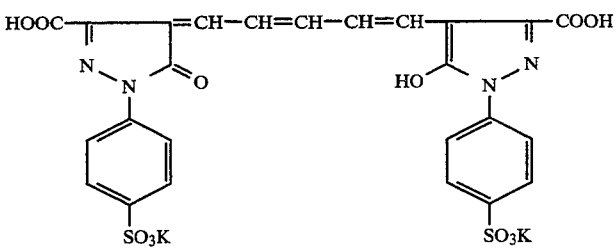

AI-1

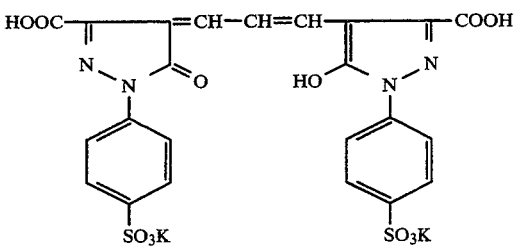

AI-2

Subsequently, multilayered color photographic light-sensitive materials, sample Nos. 2 to 7, were prepared using emulsions EM-2 to EM-7, by turns, in place of emulsion EM-1 used in sample No. 1.

TABLE 4

| Sample | 2 | 3 | 4 | 5 | 6 | 7 |
|---|---|---|---|---|---|---|
| Emulsion Used | EM-2 | EM-3 | EM-4 | EM-5 | EM-6 | EM-7 |

| Process | Processing Time | Processing Temp. |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24 − 41° C. |
| 4. Fixing | 6 min. 30 sec. | 38.0 ± 3.0° C. |
| 5. Washing | 3 min. 15 sec. | 24 − 41° C. |
| 6. Stabilizing | 3 min. 15 sec. | 38 ± 3.0° C. |
| 7. Drying | | below 50° C. |

Compositions of the processing solutions used in the respective processes were as follows:

| | |
|---|---|
| Color Developer | |
| 4-Amino-3-methyl-N-ethyl-N-(β-hydroxyethyl)-aniline. sulfate | 4.75 g |
| Anhydrous sodium sulfite | 4.25 g |
| Hydroxylamine.1/2sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water was added to 1 liter, and the pH was adjusted to 10.1. | |
| Bleach | |
| Ammonium ferric ethylenediaminetetraacetate | 100.0 g |
| Diammonium ethylenediaminetetraacetate | 10.0 g |
| Ammonium bromide | 150.0 g |
| Glacial acetic acid | 10.0 g |
| Water was added to 1 liter, and the pH was adjusted to 6.0 with aqueous ammonia. | |
| Fixer | |
| Ammonium thiosulfate | 175.0 g |
| Anhydrous sodium sulfite | 8.5 g |

-continued

| | |
|---|---|
| Sodium metasulfite | 2.3 g |
| Water was added to 1 liter, and the pH was adjusted to 6.0 with acetic acid. | |
| Stabilizer | |
| Formalin (37% aqueous solution) | 1.5 ml |
| Koniducks made by Konica Corp. | 7.5 ml |
| Water was added to 1 liter. | |

After preparation of the samples, each of them was immediately evaluated for the relative fog, graininess and pressure desensitization using green light (G). The results are shown in Table 5.

Employing a green light (G), the relative sensitivity, pressure fogging and pressure desensitization of each sample prepared in the above-mentioned manner were measured. Table 5 shows the results thereof.

In the Table, the relative sensitivity is a relative value of the inverse number of the exposure amount giving the density of Dmin (the minimum density)+0.15. It is represented by a relative sensitivity when the red light sensitivity of Sample 1 is defined to be 100. The smaller the value is, the more the sensitivity is deteriorated.

Evaluation on durability to pressure was tested in the following manner under the temperature of 23° C. and the relative humidity of 55%.

A needle having a tip of 0.025 mm provided in a tester for scratch tension (produced by Shinto Kagaku Co., Ltd.) wherein a load of 5 g was applied and pulled on a film. After that, the film was subjected to wedge exposure and color developing processing.

The resulting samples were scanned by the use of a microdensitometer so that the level of pressure fogging was measured by means of the change in density ($\Delta D_1$) at the portion where the load was applied in Dmin density.

With regard to pressure desensitization, the change in density ($\Delta D_2$) occurred at the portion where the load was applied in the density of Dmin+0.4. In both cases of ($\Delta D_1$) and ($\Delta D_2$), the change in density was respectively represented by a relative value when the value of Sample 1 was defined to be 100.

The larger the value is, the more the sample is deteriorated. The following Table 5 shows the results thereof.

TABLE 5

| Sample | Green-sensitive Layer | | | |
|---|---|---|---|---|
| | Sensitivity | Pressure fog | Pressure Desensitization | Remarks |
| 1 | 100 | 100 | 100 | Invention |
| 2 | 98 | 103 | 107 | Invention |
| 3 | 102 | 105 | 105 | Invention |
| 4 | 95 | 195 | 155 | Comparison |
| 5 | 100 | 109 | 192 | Comparison |
| 6 | 95 | 150 | 125 | Comparison |
| 7 | 97 | 197 | 191 | Comparison |

As is apparent from Table 5, sample Nos. 1 to 3 of the invention, which contained emulsions EM-1 to EM-3 of the invention respectively, were high in sensitivity and low in fogging by pressure, and improved in pressure desensitization. Of these samples, sample No. 1 using emulsion EM-1 which best satisfied the combination according to the invention was especially excellent.

On the contrary, emulsion EM-4 for comparison was greatly deteriorated in pressure fog because it had no continuous structure in iodide composition. Emulsion EM-5 was significantly deteriorated in pressure fog, since an oxidizing agent of the invention was not contained during grain formation.

Emulsion EM-6 was deteriorated in pressure fog, because its iodide composition, though changed continuously, deviated from the maximum iodide content point ($L_1$) and minimum iodide content point ($L_2$) of the invention. Emulsion EM-7 was greatly deteriorated in both pressure fog and pressure desensitization, because it largely deviated from the requirements of continuous change in iodide composition and contained no oxidizing agent during grain formation according to the invention.

What is claimed is:

1. A silver halide photographic light-sensitive material comprising a support having thereon a silver halide emulsion layer containing silver halide grains, wherein said silver halide grains are formed in the presence of a halogen oxidizing agent; and the silver halide grains thus formed each have a maximum silver iodide content at a distance of $L_1$ from the grain center and a minimum silver iodide content at a distance of $L_2$ from the grain center, wherein $L_1$ is less than 0.67 L, $L_2$ is 0.58 L or more, and L represents a distance from the grain center to the grain surface; the silver iodide content decreases substantially monotonously from the point of distance $L_1$ to the point of distance $L_2$ and the following relation is satisfied:

$$(L_2-L_1)/L \geqq 0.20$$

2. The silver halide photographic material of claim 1, wherein said oxidizing agent is iodine.

3. The silver halide photographic material of claim 1, wherein said oxiding agent is added at a time between the point of $L_1$ and the point of $L_2$ during the course of grain growth.

4. The silver halide photographic material of claim 1, wherein the difference of silver iodide content between the point of $L_1$ and the point of $L_2$ is 5 to 40 mol %.

5. The silver halide photographic material of claim 1, wherein said silver halide grains are monodispersed.

6. The silver halide photographic material of claim 1, wherein said silver halide grains are silver iodobromide grains having an average silver iodide content of 1 to 20 mol %.

7. A method for preparing a silver halide emulsion comprising silver halide grains, comprising:

(a) forming silver halide seed grains by reacting a silver salt and a halide salt, and (b) growing silver halide grains from the thus formed seed grains further by adding a silver salt and a halide salt, wherein in (b), an oxidizing agent is made present; and the silver halide grains thus formed each have a maximum silver iodide content at a distance of $L_1$ from the grain center and a minimum silver iodide content at a distance of $L_2$ from the grain center, wherein $L_1$ is from 0 to 0.67 L, $L_2$ is from 0.58 L to L, and L represents a distance from the grain center to the grain surface; the silver iodide content decreases substantially monotonously in the range of $L_1$ to $L_2$ and the following relation is satisfied:

$$(L_2-L_1)/L \geqq 0.20$$

8. The method of claim 7, wherein the amount of said oxidizing agent is within a range of $10^{-7}$ to $10^{-1}$ mol/mol Ag.

9. The method of claim 7, wherein in (b), the silver halide grains are grown further by adding silver halide fine grains.

* * * * *